US007684744B2

(12) United States Patent
Uchida

(10) Patent No.: US 7,684,744 B2
(45) Date of Patent: Mar. 23, 2010

(54) FIXING DEVICE WITH SEPARATION CLAWS AND IMAGE FORMING APPARATUS INCLUDING THE DEVICE

(75) Inventor: Shinichi Uchida, Osaka (JP)

(73) Assignee: Kyocera Mita Corporation (JP)

( * ) Notice: Subject to any disclaimer, the term of this patent is extended or adjusted under 35 U.S.C. 154(b) by 371 days.

(21) Appl. No.: 11/807,818

(22) Filed: May 30, 2007

(65) Prior Publication Data

US 2007/0280752 A1 Dec. 6, 2007

(30) Foreign Application Priority Data

May 31, 2006 (JP) ..... 2006-151058

(51) Int. Cl.
*G03G 15/20* (2006.01)

(52) U.S. Cl. ..... 399/323

(58) Field of Classification Search ..... 399/323, 399/398, 399; 271/307, 308, 311, 312, 900
See application file for complete search history.

(56) References Cited

U.S. PATENT DOCUMENTS 6,265,694 B1 * 7/2001 Pirwitz ..... 219/216
7,013,572 B1 * 3/2006 Morganti et al. ..... 399/323
7,486,922 B2 * 2/2009 Nakano et al. ..... 399/323
2005/0008408 A1 1/2005 Inomata
2007/0048036 A1 * 3/2007 Kanematsu et al. ..... 399/323

FOREIGN PATENT DOCUMENTS

JP 01032279 A * 2/1989
JP 07064431 A * 3/1995
JP 2003345163 A * 12/2003
JP 2004-191520 7/2004
JP 2005-24700 1/2005
JP 2005-31350 2/2005

* cited by examiner

*Primary Examiner*—Robert Beatty
(74) *Attorney, Agent, or Firm*—Gerald E. Hespos; Anthony J. Casella

(57) ABSTRACT

A fixing device includes a fixing roller that heats a toner image. A pressure roller forms a nip with the fixing roller by contacting and pressing the fixing roller. Separation claws are disposed side by side along a shaft center of the fixing roller within a sheet passing region of the fixing roller on a downstream side from the nip in a carrying direction of the recording sheet to separate the recording sheet from the fixing roller. Each claw includes a tip that contacts a circumferential surface of the fixing roller. The claws are disposed so that an interval from the nip to the tip of a claw at a position close to at least one end of the sheet passing region becomes smaller than an interval from the nip to the tip of a claw at a position other than the position close to the end.

12 Claims, 10 Drawing Sheets

FIXING DEVICE WITH SEPARATION CLAWS AND IMAGE FORMING APPARATUS INCLUDING THE DEVICE

BACKGROUND OF THE INVENTION

1. Field of the Invention

The present invention relates to a fixing device that fixes a toner image transferred onto a recording sheet on the recording sheet and an image forming apparatus equipped with the same.

2. Description of the Related Art

There has been known a fixing device used in an image forming apparatus, such as a printer and a copying machine, for fixing a toner image transferred onto a recording sheet on the recording sheet. Such a fixing device adopts means by which an elastic layer (rubber layer) is provided to a pressure (press) roller and a fixing (heat) roller, so that a recording sheet is separated from the circumferential surface of the fixing roller by a nip shape formed by the pressure roller and the fixing roller.

In a case where the elastic layer is provided to the fixing roller, however, the low thermal conductivity of the elastic layer causes inconveniences, such as deterioration in the characteristics of temperature following during a continuous sheet passing operation and an extension of the warm-up time, which makes it difficult to reach a satisfactory level to respond to the trend toward energy conservation in recent years. A technique of fixing a toner image on a recording sheet with the use of a belt has been proposed and is now adopted in commercially available products. This technique, however, makes the structure complex and has an inconvenience that the cost is increased.

Meanwhile, there is known a fixing device that uses, as the fixing roller, a so-called hard roller formed by covering the surface of the cored bar made of aluminum or iron with a coating or a tube of fluorocarbon resin. This fixing device is able to shorten the warm-up time sufficiently owing to the high thermal conductivity of the fixing roller, and the fixing device can be manufactured at a low cost.

In a case where the fixing (hard) roller described above is used, however, a high adhesion force develops between the fixing roller and a recording sheet where a large amount of fused toner particles are present. It is therefore necessary to use means for forcedly separating a recording sheet from the circumferential surface of the fixing roller by bringing a separation claw into contact with the fixing roller. In this case, the occurrence of sheet jamming caused by the separation claw has to be suppressed to the extent possible.

SUMMARY OF THE INVENTION

An object of the invention is to provide a fixing device using a separation claw and capable of suppressing the occurrence of jamming to the extent possible, and an image forming apparatus equipped with such a fixing device.

The above and other objects are achieved by a fixing device according one aspect of the invention, including: a fixing roller that heats a toner image; a pressure roller that forms a nip portion together with the fixing roller by coming into contact with the fixing roller with pressing and fixes the toner image on a recording sheet in the nip portion; and plural separation claws that are disposed side by side along a shaft center of the fixing roller within a sheet passing region of the fixing roller on a downstream side from the nip portion in a carrying direction of the recording sheet and separate the recording sheet from the fixing roller, wherein each of the plural separation claws includes a tip end claw portion that comes into contact with a circumferential surface of the fixing roller, and the plural separation claws are disposed in such a manner that an interval from the tip end claw portion of a separation claw at a position in close proximity to at least one end portion of the sheet passing region to the nip portion becomes smaller than an interval from the tip end claw portion of a separation claw at a position other than the position in close proximity to the end portion to the nip portion.

An image forming apparatus according to another aspect of the invention includes an image forming portion that transfers a toner image on a recording sheet, and a fixing device that fixes the toner image transferred in the image forming portion on the recording sheet by heating, and the fixing device has the configuration described above.

DETAILED DESCRIPTION OF THE PREFERRED EMBODIMENTS

Hereinafter, embodiments of the invention will be described with reference to the drawings.

Figure 1:
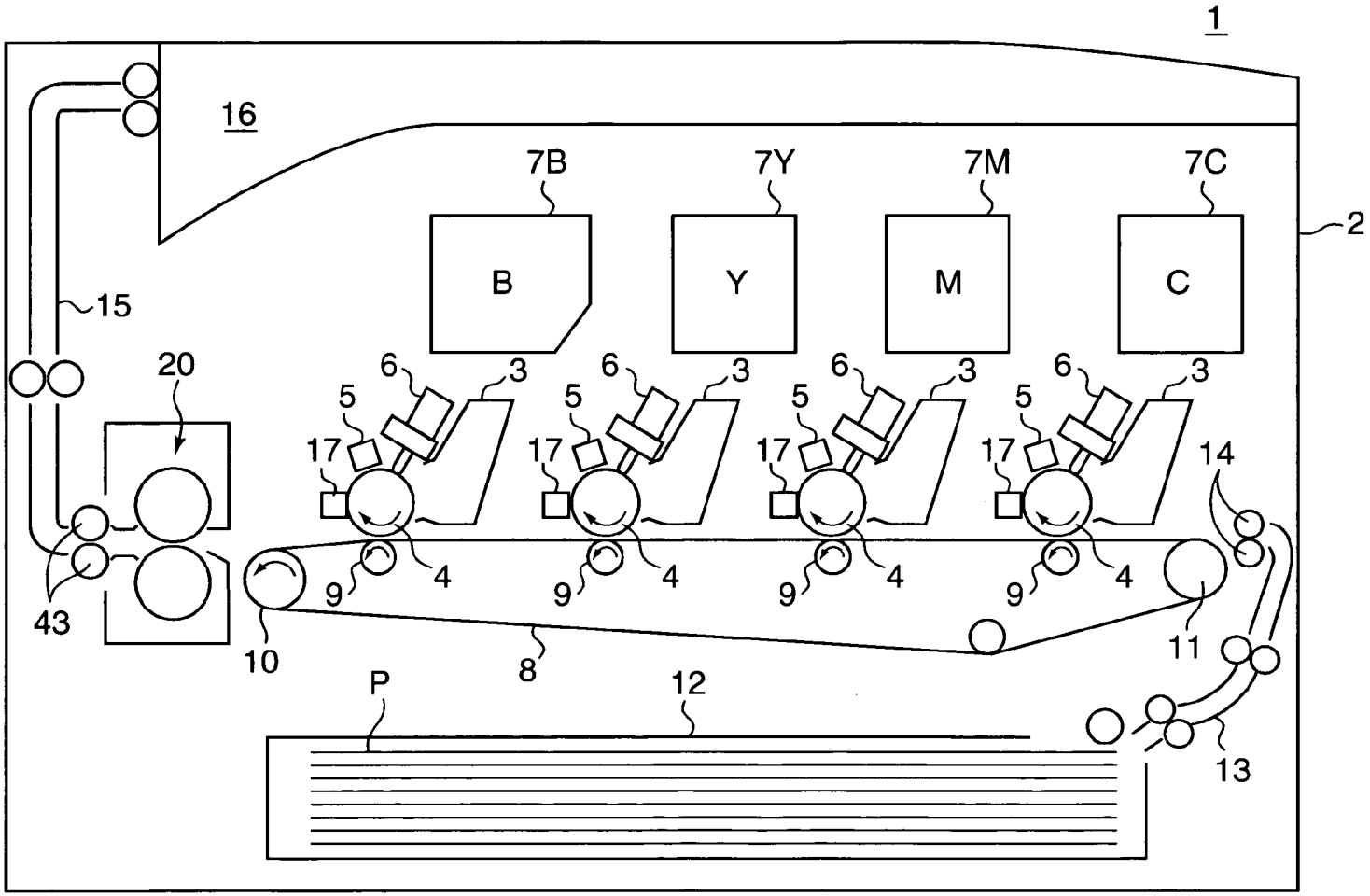
FIG. 1 is a sectional front view showing the overall configuration of a printer according to one embodiment of the invention.
Figure 2:
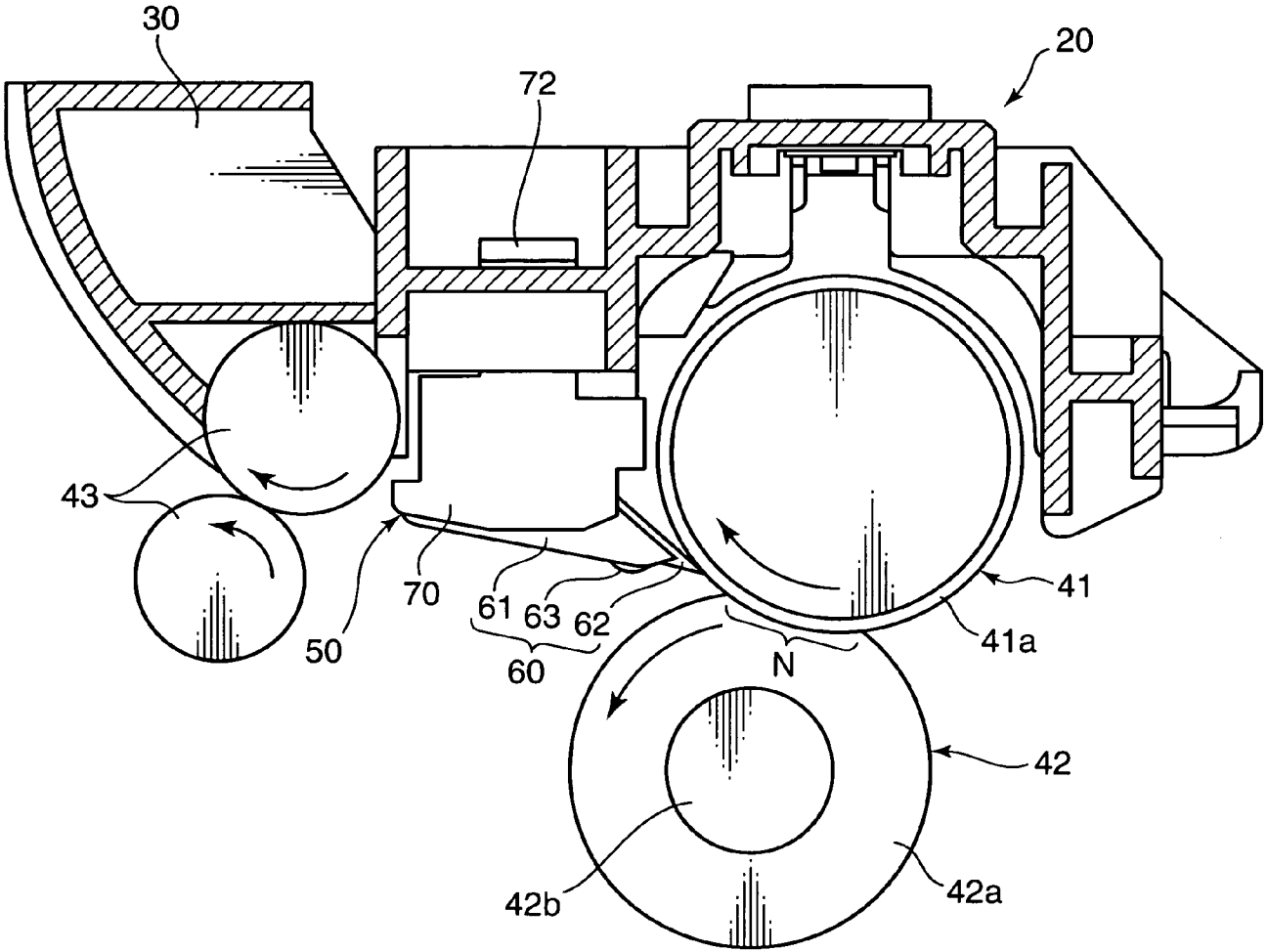
FIG. 2 is a front view of a fixing device in the printer shown in FIG. 1.
Figure 3:
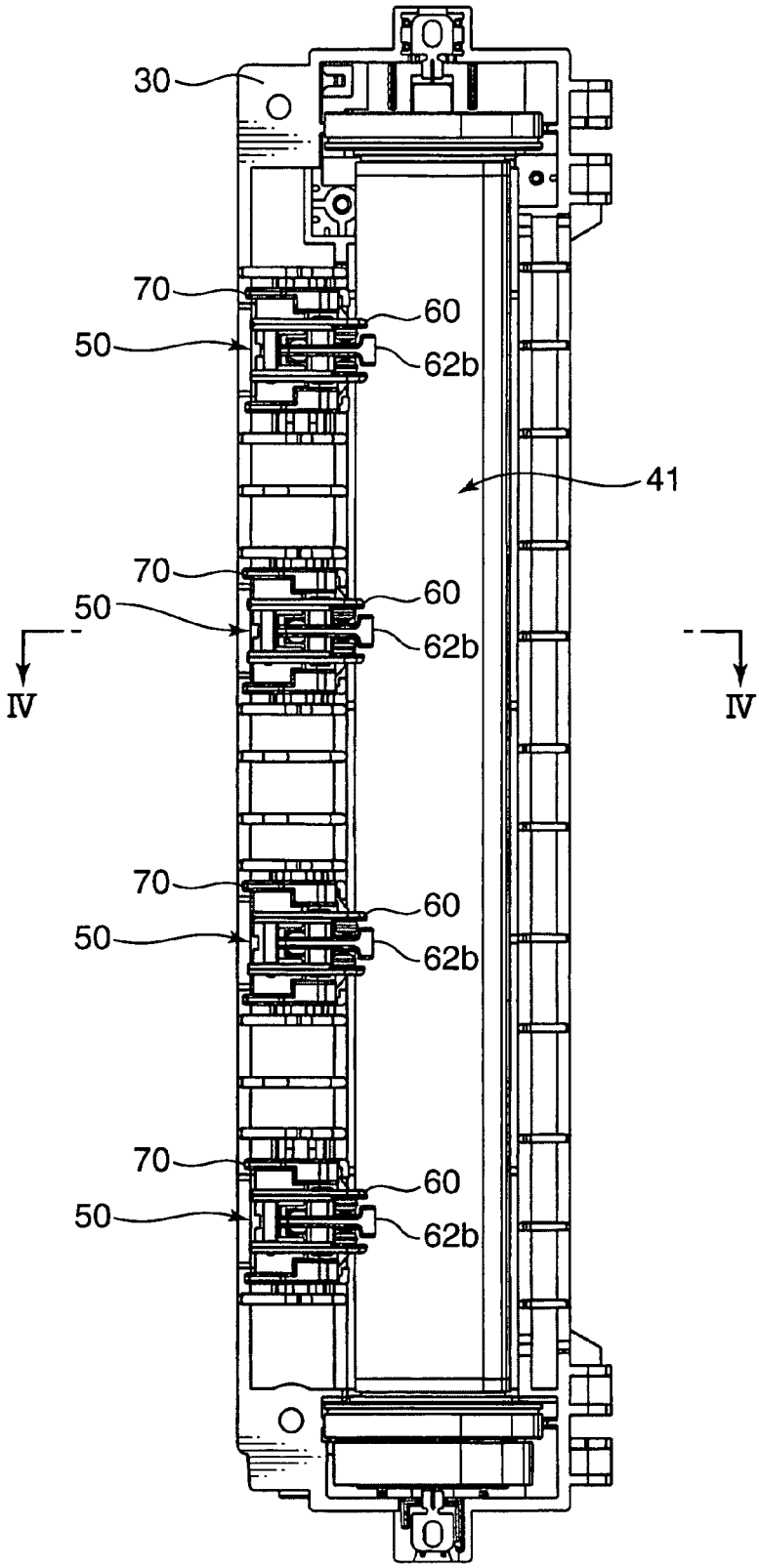
FIG. 3 is a bottom view showing separation mechanisms and a fixing roller in the fixing device shown in FIG. 2.
Figure 4:
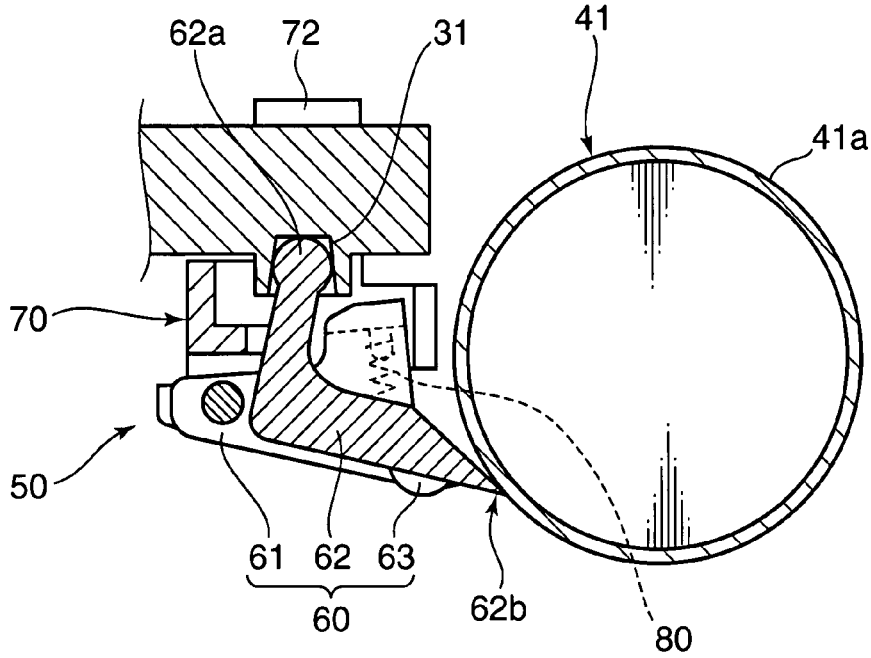
FIG. 4 is a cross section taken along line IV-IV of FIG. 3.
Figure 9:
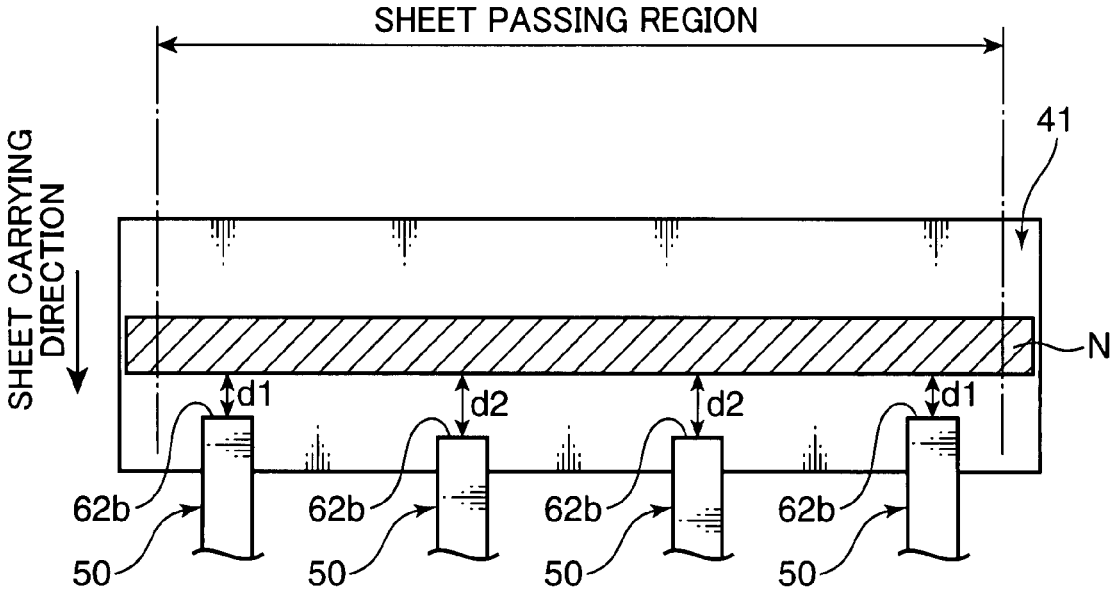
FIG. 9 is a bottom view schematically showing the positional relation of the separation mechanisms and the fixing roller in the fixing device shown in FIG. 2.
Figure 10:
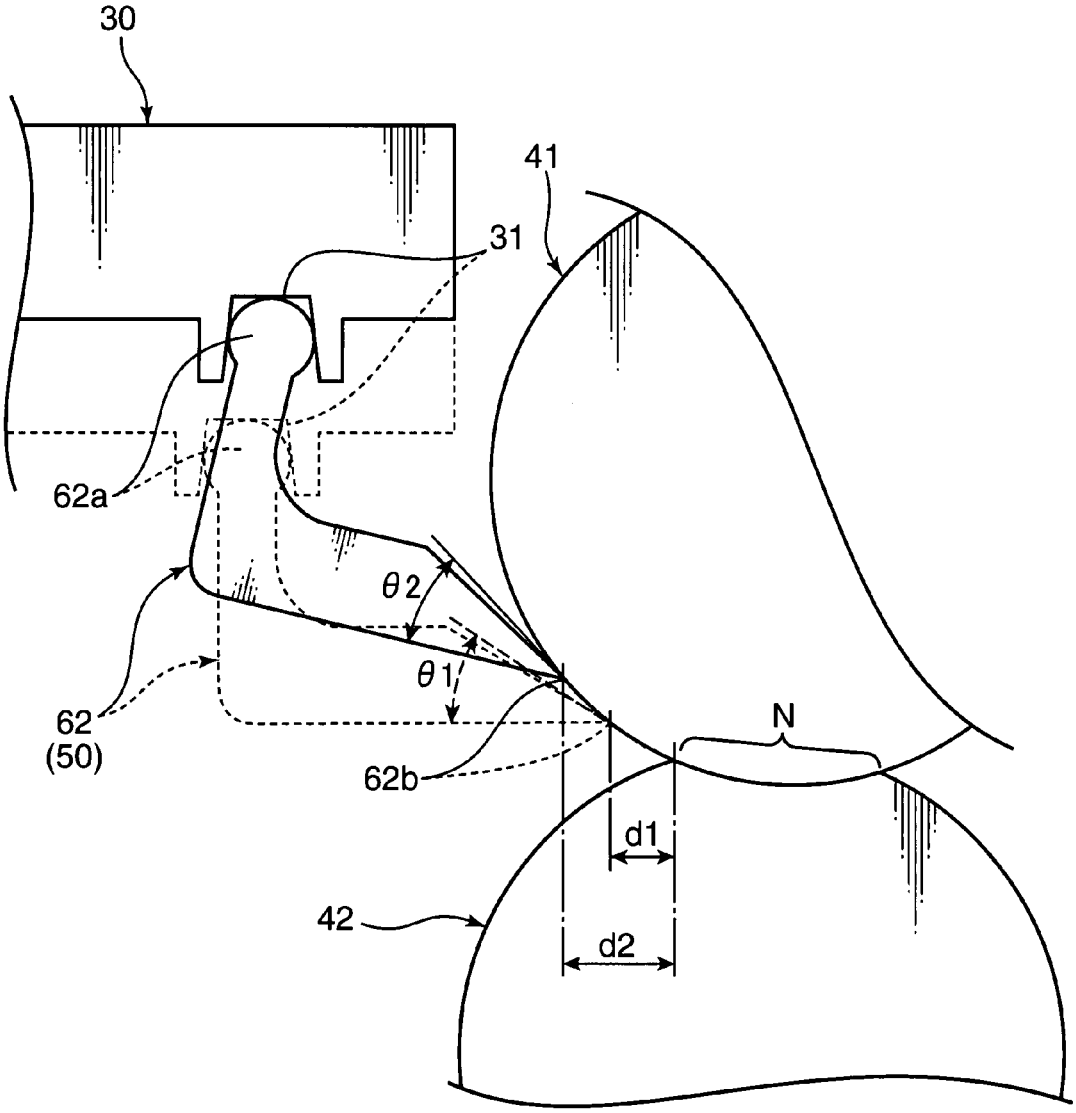
FIG. 10 is a schematic front view used to describe the angles of contact between the separation claw unit and the fixing roller.

FIG. 1 is a sectional front view showing the overall configuration of a printer according to one embodiment of the invention. FIG. 2 is a front view of a fixing device in the printer shown in FIG. 1. FIGS. 3 and 4 are views of separation mechanisms and a fixing roller in the fixing device shown in FIG. 2. FIGS. 5 through 8C are views of the separation mechanism in the fixing device shown in FIG. 2. FIG. 9 is a bottom view schematically showing the positional relation of the separation mechanisms and the fixing roller in the fixing device shown in FIG. 2. FIG. 10 is a schematic front view used to describe the angles of contact between a separation claw unit and the fixing roller. To begin with, the overall configuration of a printer 1 according to one embodiment of the invention will be described with reference to FIG. 1.

As is shown in FIG. 1, in the printer 1, developing devices 3 for respective colors including cyan, magenta, yellow, and black are provided inside a printer main body 2. Each developing device 3 is provided with a photoconductive drum 4 made of a-Si (amorphous silicon) or the like, and configured to rotate in a direction indicated by the arrow in the drawing. The photoconductive drum 4 is charged uniformly by a charger 5, and an electrostatic latent image is formed on the surface of the photoconductive drum 4 as LED light is irradiated thereon from an exposing device (LED print heat unit or the like) 6 according to original document image data inputted from an external PC (Personal Computer) or the like. A toner image is formed as toner particles adhere to the electrostatic latent image. Toner particles are supplied from respective toner supply containers 7C, 7M, 7Y, and 7B.

A carrying belt 8 is provided below the photoconductive drums 4 for the respective colors that are aligned side by side. The carrying belt 8 is in a state where it is pressed against the respective photoconductive drums 4 by corresponding transfer rollers 9. The carrying belt 8 is rotated in the forward direction of the rotational direction of the photoconductive drums 4 by a drive roller 10 that is driven to rotate by an unillustrated motor or the like and a driven roller 11 rotating in association with the carrying belt 8 that is rotated endlessly by the drive roller 10. It should be noted that the developing devices 3, the photoconductive drums 4, the chargers 5, the exposing devices 6, the toner supply containers 7C, 7M, 7Y, and 7B, the carrying belt 8, the transfer rollers 9, the drive roller 10, the driven roller 11, and cleaning devices 17 described below together form an "image forming portion" of the invention.

A sheet feeding portion 12 accommodating recording sheets P is disposed below the image forming portion. A recording sheet P is carried toward the carrying belt 8 from the sheet feeding portion 12 by way of a sheet carrying path 13. Timing of an image transfer action and a sheet feeding action by the respective photoconductive drums 4, the respective transfer rollers 9, and so forth is adjusted by a registration roller pair 14.

After the timing is adjusted, the registration roller pair 14 is driven to rotate and a recording sheet P is carried through spaces between the photoconductive drums 4 and the carrying belt 8. While the recording sheet P is carried through spaces between the respective photoconductive drums 4 and the carrying belt 8, toner images in the respective colors on the surfaces of the respective photoconductive drums 4 are sequentially transferred onto the recording sheet P. The recording sheet P on which the toner images are transferred by all the photoconductive drums 4 is carried into a fixing device 20 for the toner images to be fixed thereon. A color image is thus formed. The recording sheet P having passed through the fixing device 20 is sent to a sheet carrying path 15 and discharged onto a sheet discharge portion 16. Each photoconductive drum 4 is provided with the cleaning device 17 that removes residual toner particles or the like on the photoconductive drum 4.

The configuration of the fixing device 20 will now be described in detail with reference to FIGS. 2 through 10.

As is shown in FIG. 2, the fixing device 20 includes, inside a housing 30 serving as the apparatus main body, a fixing (heat) roller 41 capable of generating heat and a pressure (press) roller 42 provided below the fixing roller 41 in such a manner that the circumferential surface thereof and the circumferential surface of the fixing roller 41 oppose each other. A recording sheet P done with the transfer processing undergoes the fixing processing as heat is conferred thereto from the fixing roller 41 while it passes by a nip portion N between the fixing roller 41 rotated for driving in a clockwise direction and the pressure roller 42 driven to rotate in a counterclockwise direction.

The fixing roller 41 includes an outside cylindrical body 41*a* formed by coating a specific material on the circumferential surface of a cylindrical body made of metal and a heat source (not shown) formed of, for example, a halogen lamp and provided inside the outside cylindrical body 41*a*. An unillustrated ring gear is fixed to one end of the outside cylindrical body 41*a*, and the outside cylindrical body 41*a* is rotated for driving about the shaft center as driving rotations of a motor (not shown) provided to the outside of the housing 30 at an appropriate position are transmitted to the ring gear via a gear mechanism or the like.

The pressure roller 42 includes a pressure roller main body 42*a* of a cylindrical shape and a pressure roller shaft 42*b* provided coaxially with the pressure roller main body 42*a* and penetrating through the end wall of the pressure roller main body 42*a*. The pressure roller 42 is driven to rotate by the driving rotations of the fixing roller 41 as it is pressed against the circumferential surface of the outside cylindrical body 41*a* of the fixing roller 41 at the nip portion N.

Also, as are shown in FIGS. 2 and 3, the fixing device 20 is provided with plural (four in this embodiment) separation mechanisms 50 attached to the housing 30 at appropriate positions in a posture such that allows them to come into contact with a recording sheet P on the downstream side in the carrying direction from the nip portion N on the circumferential surface of the fixing roller 41. These separation mechanisms 50 are disposed side by side and spaced apart at specific intervals along the shaft center of the fixing roller 41 within a sheet passing area (see FIG. 9) of the fixing roller 41. A discharge roller pair 43 that forces a recording sheet P done with the fixing processing to be headed toward the sheet transfer path 15 (see FIG. 1) is provided downstream from the separation mechanisms 50 (on the left in FIG. 2). The separation mechanisms 50 are an example of "separation claws" of the invention.

In this fixing device 20, a recording sheet P is carried by the fixing roller 41 and the pressure roller 42 since the front end of the recording sheet P passed by the nip portion N between the fixing roller 41 and the pressure roller 42 until it reaches the discharge roller pair 43. Since the front end of the recording sheet P reached the discharge roller pair 43 until the rear end of the recording sheet P passes by the nip portion N, the recording sheet P is carried by the fixing roller 41, the pressure roller 42, and the discharge roller pair 43 that rotate in synchronization with one another. After the rear end of the recording sheet P passes by the nip portion N, the recording sheet P is carried by the discharge roller pair 43 alone.

Each separation mechanism 50 is furnished with the capability of separating a recording sheet P trying to wind around the circumferential surface of the fixing roller 41 from the circumferential surface of the fixing roller 41, and includes a separation claw unit 60, a supporting member 70, and a pair of compression coil springs 80 (see FIG. 4).

Figure 5:
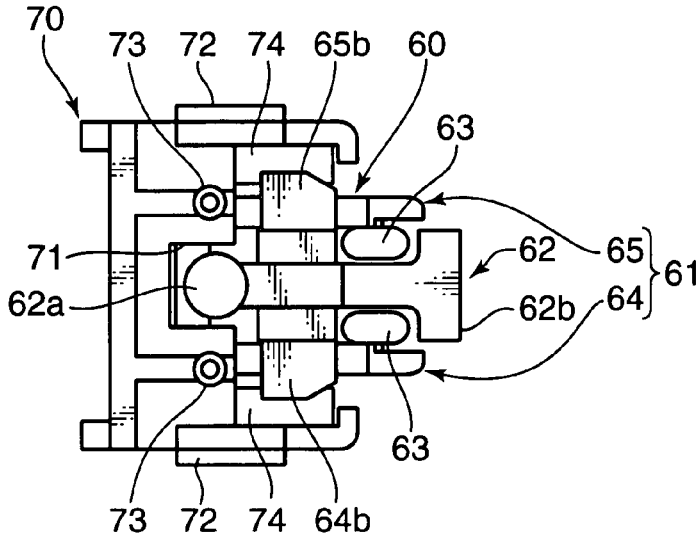
FIG. 5 is a plan view of the separation mechanism in the fixing device shown in FIG. 2.

The separation claw unit 60 includes a holder member 61, a claw member 62 almost in the shape of a capital L when viewed from the front, and a pair of roller members 63 (see FIG. 5).

The holder member 61 holds the claw member 62 immovably, and as is shown in FIG. 2, it is provided so as to stay in a non-contact state with respect to the fixing roller 41, and formed in a shape capable of housing the claw member 62 and the roller members 63. The holder member 61 is formed of a male holder 64 of a male mold structure and a female holder 65 of a female mold structure.

Figure 6A:
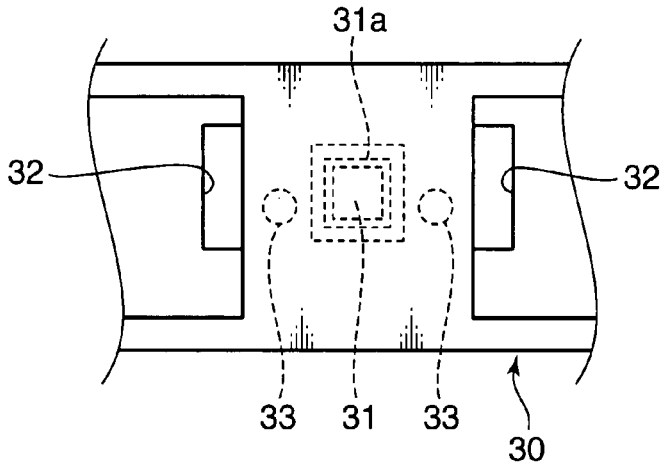
FIGS. 6A through 6C are plan views showing a state where the separation mechanism is disassembled, FIG. 6A showing a part of a housing of the fixing device, FIG. 6B showing a separation claw unit and compression coil springs, and FIG. 6C showing a supporting member.
Figure 6B:
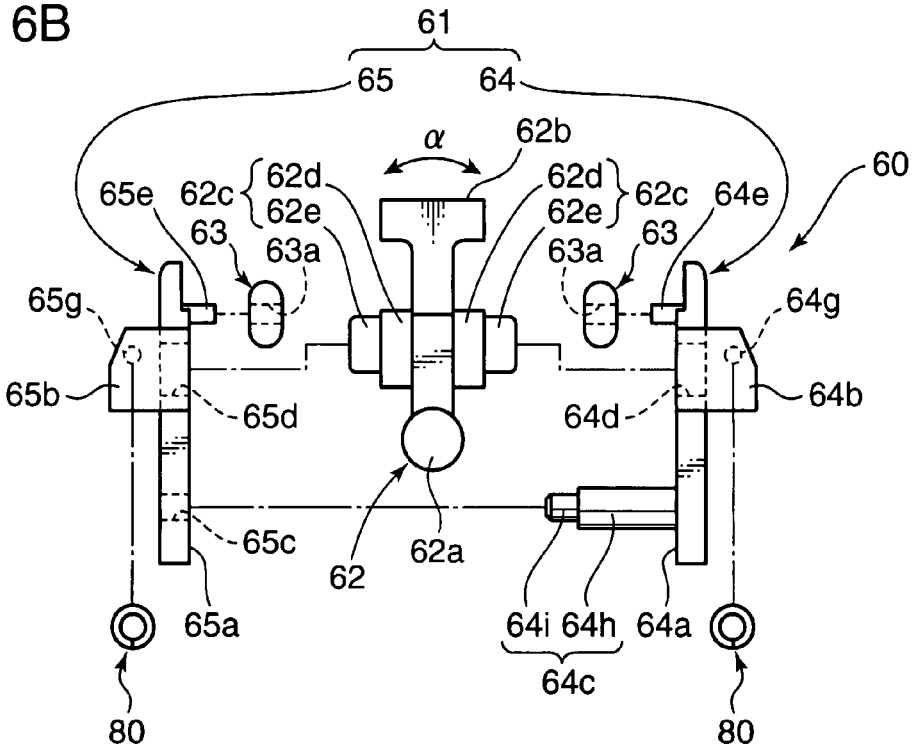
Figure 6C:
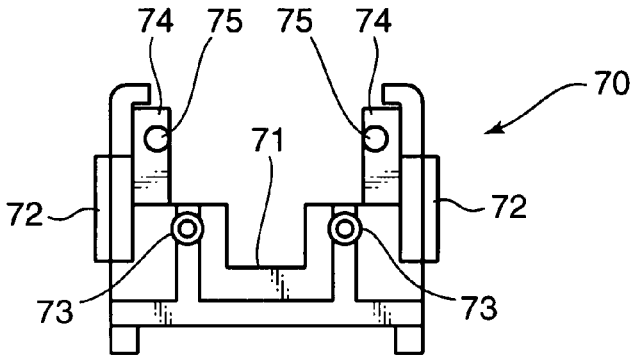
Figure 7A:
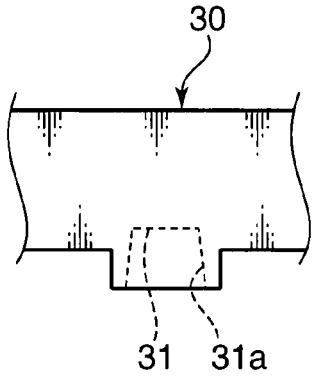
FIGS. 7A through 7C are front views showing a state where the separation mechanism is disassembled, FIG. 7A showing a part of the housing of the fixing device, FIG. 7B showing the separation claw unit and the compression coil springs, and FIG. 7C showing the supporting member.
Figure 7B:
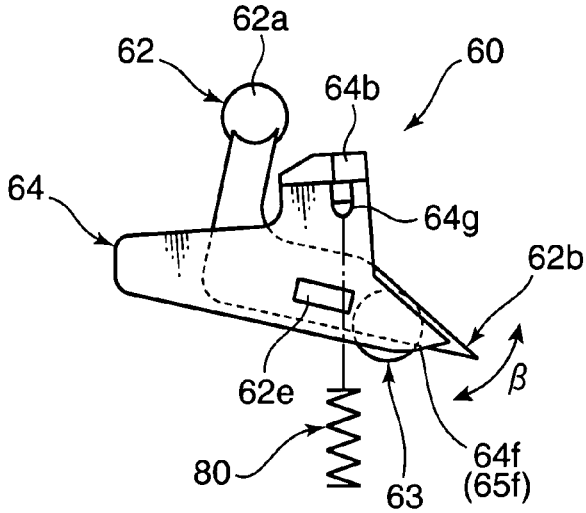
Figure 7C:
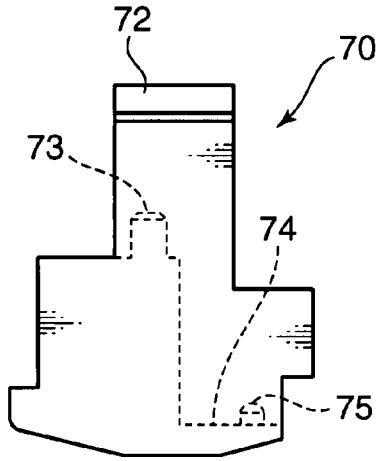
Figure 8A:
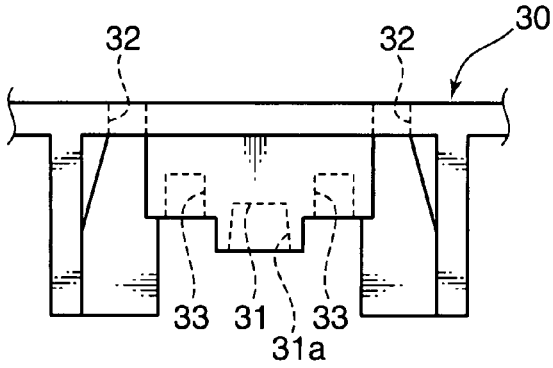
FIGS. 8A through 8C are side views showing a state where the separation mechanism is disassembled, FIG. 8A showing a part of the housing of the fixing device, FIG. 8B showing the separation claw unit and the compression coil springs, and FIG. 8C showing the supporting member.
Figure 8B:
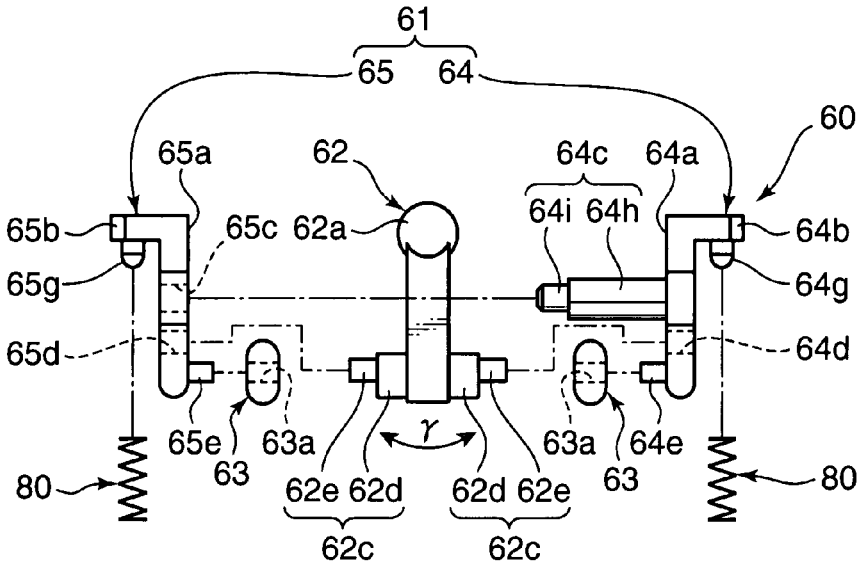
Figure 8C:
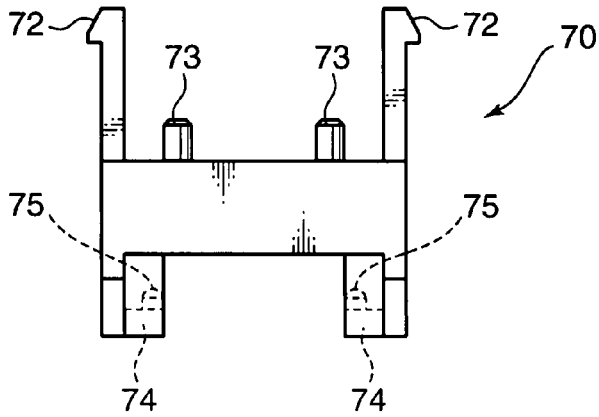

As are shown in FIGS. 6B, 7B, and 8B, the male holder 64 has a side plate 64*a* of a horizontally long shape when viewed from the front, a spring seat portion 64*b* formed on the top of the side plate 64*a*, a holder width limiting portion 64*c* formed in the side plate 64*a* on the surface opposing the female holder 65, a press-fit hole 64*d* made in the side plate 64*a* at a position corresponding to one of movement limiting portions 62*c* of the claw member 62 described below, a spindle portion 64*e* formed in the side plate 64*a* on the surface opposing the female holder 65, and a guide portion 64*f* (see FIG. 7B) provided at the bottom of the side plate 64*a* on the upstream side in the carrying path.

The female holder 65 has a side plate 65*a* of a horizontally long shape when viewed from the front, a spring seat portion 65*b* formed on the top of the side plate 65*a*, an insert-hole 65*c* made in the side plate 65*a* at a position corresponding to the holder width limiting portion 64*c* of the male holder 64, a press-fit hole 65*d* made in the side plate 65*a* at a position corresponding to the other movement limiting portion 62*c* of the claw member 62, a spindle portion 65*e* formed in the side plate 65*a* on the surface opposing the male holder 64, and a guide portion 65*f* (see FIG. 7B) provided at the bottom of the side plate 65*a* on the upstream side in the carrying path.

The spring seat portions 64*b* and 65*b* are provided to let the upper end portions of the compression coil springs 80 abut thereon, and bosses 64*g* and 65*b* to stop the upper end portions of the compression coil springs 80 are provided at the bottom surfaces of the spring seat portions 64*b* and 65*b*, respectively. When the separation claw unit 60 is assembled, the spring seat portions 64*b* and 65*b* are positioned at almost the midpoint between an oscillation supporting point portion 62*a* and the tip end claw portion 62*b* of the claw member 62 described below.

The holder width limiting portion 64*c* is provided to limit the width of the holder member 61 by limiting an interval between the respective holders 64 and 65. In other words, the holder width limiting portion 64*c* is formed of a base portion 64*h* in the shape of a cylindrical column and an insertion portion 64*i* inserted into the insert hole 65*c* of the female holder 65 and having a smaller diameter than the base portion 64*h*. It is held in a state where the side plates 64*a* and 65*a* are spaced apart at an interval as long as the length of the base portion 64*h* in the axial direction as the base portion 64*h* of the holder width limiting portion 64*c* abuts on the side plate 65*a* of the female holder 65.

The spindle portions 64*e* and 65*e* are disposed to oppose each other, and each is configured to be able to rotate the corresponding roller member 63. These spindle portions 64*e* and 65*e* protrude, respectively, from the side plates 64*a* and 65*a* in an amount of protrusion such that keeps them in a non-contact state with respect to the claw member 62.

The guide portions 64*f* and 65*f* are provided to guide the front end of a recording sheet P smoothly to the roller members 63 in the carrying path of the recording sheet P between the claw member 62 and the roller members 63.

The claw member 62 is configured to come into contact with the circumferential surface of the fixing roller 41, and has the oscillation supporting point portion 62*a*, the tip end claw portion 62*b*, and a pair of the movement limiting portions 62*c*.

The oscillation supporting point portion 62*a* is formed in an almost spherical shape, and when the separation mechanism 50 is attached to the housing 30, it is held in a supporting point reception portion 31 (see FIGS. 6A, 7A, and 8A) made in the housing 30 in a concave shape so as to be able to undergo pivotal motions. The supporting point reception portion 31 is an example of a "supporting member" of the invention.

The supporting point reception portion 31 is formed to have an almost square horizontal cross section and to widen gradually from the bottom portion to the opening portion. The oscillation supporting point portion 62*a* functions as a supporting point when the tip end claw portion 62*b* of the separation claw unit 60 described in the following paragraph moves freely in many directions (oscillates about the multiple axial directions: see arrows α, β, and γ in FIGS. 6B, 7B, and 8B, respectively). The oscillation supporting point portion 62*a* may be formed in a shape other than an almost spherical shape as described above, for example, in the shape of a circular cone.

The tip end claw portion 62*b* is provided spaced apart from the oscillation supporting point portion 62*a* at a specific interval and is formed in the shape of a flat plate with the tip end thereof having an acute angle in the longitudinal cross section. As has been described, the tip end claw portion 62*b* is configured to come into contact with the circumferential surface of the fixing roller 41 in a state where it is allowed to oscillate about the multiple axial directions using the oscillation supporting point portion 62*a* as the supporting point when the separation mechanism 50 is attached to the housing 30.

The movement limiting potions 62*c* are used to fix the claw member 62 to the holder member 61, and each is formed of a base portion 62*d* of a rectangular shape in the cross section and a press-fit portion 62*e* having a sectional shape one size smaller than the base portion 62*d*. Movements of the claw member 62 between the respective holders 64 and 65 are limited as the base portion 62*d* abuts on the side plates 64*a* and 65*a* of the holders 64 and 65, respectively. The claw member 62 whose position is limited by the base portion 62*d* of each movement limiting portion 62*c* in this manner is positioned almost at the midpoint between the side plates 64*a* and 65*a*.

As has been described, the claw member 62 is provided with its position being determined almost at the midpoint between the side plates 64*a* and 65*a* of the holders 64 and 65, respectively. Further, the tip end claw portion 62*b* is provided to protrude outward from the end portion of the holder member 61 on the upstream side in the carrying path. In addition, the tip end claw portion 62*b* abuts on the circumferential surface of the fixing roller 41 owing to pushing forces of a pair of the compression coil springs 80 at the position spaced apart at a specific interval from the end portion (nip outlet) of the nip portion N on the downstream side in the carrying direction.

A pair of the roller members 63 is held by the holder member 61 in a rotatable manner as the spindle portions 64*e* and 65*e* are inserted into the corresponding axial holes 63*a*, and provided in a space between the side plates 64*a* and 65*a* to have the claw member 62 in between. As is shown in FIG. 5, the roller members 63 are held, respectively, by the spindle portions 64*e* and 65*e* in a state where they have specific play in the protruding direction of the spindle portions 64*e* and 65*e* while being able to move away from the claw member 62. The roller members 63 are configured in such a manner that the circumferential surfaces thereof are partially exposed to the outside from the bottom of the holder member 61 while they are held by the holder member 61.

The supporting member 70 is furnished with the capability of supporting the separation claw unit 60 to be able to oscillate about the multiple axial directions for the claw member 62 of the separation claw unit 60 to constantly come into close contact with the circumferential surface of the fixing roller 41. The supporting member 70 includes a notched portion 71, a pair of hook portions 72, a pair of positioning protrusion portions 73, and a pair of spring seat portions 74.

The notched portion 71 is made by notching the supporting member 70 at an appropriate point in a rectangular shape when viewed in a plane to prevent the supporting member 70 from interfering with the claw member 62 of the separation claw unit 60.

The hook portions 72 are provided to fix the supporting member 70 to the housing 30 through engagement as they are inserted into hook engagement holes 32 made in the housing 30.

The positioning protrusion portions 73 function as position determining members when attaching the supporting member 70 to the housing 30 as they are inserted into corresponding positioning concave portions 33 made in the housing 30.

The spring seat portions 74 are provided to let the lower end portions of the compression coil springs 80 abut thereon, and bosses 75 to stop the lower end portions of the compression coil springs 80 are provided on the top surfaces of the spring seat portions 74.

A pair of the compression coil springs 80 is provided at a symmetrical position with respect to the oscillation supporting point portion 62*a* (see FIGS. 6B and 8B) along the shaft center direction of the fixing roller 41 (see FIG. 4). As has been described, a pair of the compression coil springs 80 is provided to bridge between the spring seat portions 74 of the supporting member 70 and the spring seat portions 64*b* (65*b*) of the separation claw unit 60, and configured to support the separation claw unit 60 while pushing it toward the circumferential surface of the fixing roller 41 so that the claw member 62 presses the fixing roller 41. A pair of the compression coil springs 80 is compressed so as to allow the separation claw unit 60 to abut on both the housing 30 and the circumferential surface of the fixing roller 41 owing to pushing forces of the compression coil springs 80 when the supporting member 70 is attached to the housing 30.

In the separation mechanism 50 configured as has been described, both ends (top and bottom ends in FIG. 5) of the tip end claw portion 62*b* of the claw member 62 in the separation claw unit 60 abut on the circumferential surface of the fixing roller 41 at almost the same pressing forces owing to the pushing forces of a pair of the compression coil springs 80. Also, in a case where the tip end claw portion 62*b* comes into contact with the circumferential surface of the fixing roller 41 in a one-side abutting state, the claw member 62 oscillates about the multiple axial directions (see the arrows α, β, and γ in FIGS. 6B, 7B, and 8B, respectively) using, as the supporting point, the oscillation supporting point portion 62*a* held by the cone-shaped supporting point reception portion 31 in the housing 30 so as to be able to undergo pivotal motions by following pushing forces of a pair of the compressed coil springs 80.

In this embodiment, as are shown in FIGS. 9 and 10, four separation mechanisms 50 are disposed intentionally in such a manner that intervals d1 from the tip end claw portions 62*b* (shown by a dotted line in FIG. 10) of two separation mechanisms 50 at positions in close proximity to the both end portions of the sheet passing region of the fixing roller 41 to the nip portion N become smaller than intervals d2 from the tip end claw portions 62*b* (shown by a solid line in FIG. 10) of the other two separation mechanism 50 at positions in close proximity to the center portion of the sheet passing region to the nip portion N. According to this configuration, peeling timing of a recording sheet P is staggered by allowing the tip end claw portions 62*b* of the separation mechanisms 50 at the both end portions of the sheet passing region to first come into contact with the front edge of a recording sheet P having passed by the nip portion N.

The reason why this embodiment is configured in this manner is as follows. In a case where a so-called hard roller adopting a cylindrical body made of metal is used as the fixing roller 41 as in this embodiment, a high adhesion force develops between the fixing roller and a recording sheet where a large amount of fused toner particles are present. It is therefore necessary to forcedly separate the recording sheet from the circumferential surface of the fixing roller by bringing the separation claw into contact with the fixing roller.

When a separation claw having a sharp tip end is used, there is an inconvenience that the fixing roller wears out during repetitive use. Given these circumstances, a technique of reducing a contact pressure applied on the fixing roller from the separation claw by widening the tip end of the separation claw in suppressing wear of the fixing roller caused by the separation claw is proposed in JP-A-2004-191520. In this cited patent document, a recording sheet is peeled from the circumferential surface of the fixing roller by bringing the tip ends of plural separation claws provided side by side along the shaft center of the fixing roller into contact with the circumferential surface of the fixing roller. The tip end claw portion 62*b* of this embodiment is also formed in the shape of a flat plate as described above, and thereby reduces a contact pressure.

In the fixing device disclosed in the cited patent document, however, plural separation claws are disposed in such a manner that intervals from the tip ends of the respective separation claws to the nip portion become almost equal. Hence, the tip ends of the respective separation claws come into contact with the front edge of a recording sheet having passed by the nip portion almost at the same time. It should be noted that the closely contacting area of a recording sheet and the fixing roller having the center at the peeling start point by the separation claws in a case where the peeling start point is set at the center portion in the width direction of a recording sheet increases almost twice as much as that in a case where the peeling start point is set at the end portions in the width direction of a recording sheet. This makes it difficult to peel a recording sheet from the fixing roller at the center portion in the width direction of a recording sheet.

Hence, when plural separation claws are disposed so that intervals from the tip ends of the respective separation claws to the nip portion become almost equal, jamming readily occurs at the center portion in the width direction of a recording sheet. On the contrary, by intentionally establishing the relation, d1<d2, as in this embodiment, so that the tip end claw portions 62*b* of the separation mechanisms 50 at the both end portions of the sheet passing region are allowed to first come into contact with the front edge of a recording sheet P where an adhesion load between a recording sheet and the fixing roller is relatively small, it is possible to suppress the occurrence of jamming.

A concrete example is as follows. In a case where the color printer 1 is equipped with a fixing roller 41 having, for example, a diameter of about 30 mm and a width of the sheet passing region of about 216 mm, it is preferable to configured in such a manner that the interval d1 is about 0.6 mm smaller than the interval d2. By setting the two intervals d1 and d2 in this manner, it is possible to ensure the relation, d1<d2, even when a dimension error and an attachment tolerance of the respective members forming the fixing device 20 are taken into account. Although there is only a slight difference between the intervals d1 and d2 on the actual apparatus as described above, a difference between these intervals is illustrated in exaggeration in FIG. 9 for ease of understanding.

Also, in this embodiment, as is shown in FIG. 10, it is configured in such a manner that the intervals d1 and d2 from the tip end claw portions 62*b* to the nip portion N can be adjusted by changing the positions of arrangement of the supporting point reception portions 31 made in the housing 30 with respect to the nip portion N. It is thus possible to use the separation mechanisms 50 of substantially the identical shape commonly in every place.

Incidentally, in a case where the separation mechanisms 50 (the claw members 62) are disposed so as to come into contact with the circumferential surface of the fixing roller 41 at various appropriate places in a specific posture in order to adjust the intervals from the tip end claw portions 62*b* to the nip portion N, the angle of contact between the tip end claw portion 62*b* and the circumferential surface of the fixing roller 41 varies with the position of arrangement. This may possibly impose a risk that the angle of contact falls outside the range of angle to achieve the satisfactory peeling capability for a recording sheet P of the tip end claw portion 62*b*.

Hence, in this embodiment, it is configured in such a manner that angles of contact, θ1 and θ2, between the tip end claw portions 62*b* and the circumferential surface of the fixing roller 41 can be adjusted as well by changing the positions of arrangement of the supporting point reception portions 31 with respect to the nip portion N. When configured in this manner, it is possible to suppress the occurrence of an event that angles of contact, θ1 and θ2, between the tip end claw portions 62*b* in the separation mechanisms 50 and the circumferential surface of the fixing roller 41 falls outside the range of angle to achieve the satisfactory peeling capability. In this embodiment, the respective supporting point reception units 31 are disposed at positions determined with respect to the nip portion N, so that the angle of contact, θ1, of the separation mechanisms 50 at the both ends of the sheet passing region and the angle of contact, θ2, of the separation mechanisms 50 at the center of the sheet passing region become almost equal.

For example, referring to FIG. 10, in order to dispose the tip end claw portion 62*b* at a position in closer proximity to the nip portion N without changing the angle of contact between the tip end claw portion 62*b* and the circumferential surface of the fixing roller 41, the position of arrangement of the supporting point reception portion 31 is moved to the lower right in the drawing together with a movement of the tip end claw portion 62*b* so as to come closer to the nip portion N, and it is also moved slightly to the lower left in the drawing so as to correct the angle of contact. In other words, by changing the position of arrangement of the supporting reception portion 31 to a lower position in a slightly leftward direction, it is possible to dispose the tip end claw portion 62*b* in close proximity to the nip portion N while maintaining the angle of contact with the circumferential surface of the fixing roller 41 intact.

According to the configuration of this embodiment, as has been described, four separation mechanisms 50 are disposed in such a manner that the intervals d1 from the tip end claw portions 62*b* of the separation mechanism 50 at the positions in close proximity to the end portions of the sheet passing region to the nip portion N become the smallest by disposing them so that the intervals d1 from the tip end claw portions 62*b* of the separation mechanisms 50 at positions in close proximity to the end portions of the sheet passing region to the nip portion N become smaller than the interval d2 from the tip end claw portions 62*b* of the separation mechanisms 50 at positions in close proximity to the center portion of the sheet passing region to the nip portion N. It is thus possible to first bring the tip end claw portions 62*b* of the separation mechanisms 50 at the end portions of the sheet passing region into contact with the front edge of a recording sheet P having passed by the nip portion N.

Herein, the closely contacting area of a recording sheet P and the fixing roller 41 having the center at the peeling start point by the separation mechanisms 50 in a case where the peeling start point is set at the end portions in the width direction of a recording sheet P reduces to almost one-half of that in a case where the peeling start point is set at the center portion in the width direction of a recording sheet P. It is thus possible to peel a recording sheet P from the fixing roller 41 with relative ease in the end portions in the width direction of a recording sheet P. In short, it is possible to start the peeling of a recording sheet P from the circumferential surface of the fixing roller 41 in a reliable manner by setting the start point at the end portions in the width direction of a recording sheet P.

Because it is possible to reduce the closely contacting area of a recording sheet P and the fixing roller 41 having the center at the peeling start points by the separation mechanisms 50 at positions closer to the center portion in the width direction by the peeling at the end portions in the width direction of a recording sheet P, the peeling capability for a recording sheet P of the separation mechanisms 50 closer to the center portion can be enhanced. Because it is possible to enhance the peeling capability for an entire recording sheet P including the center portion side in the width direction of a recording sheet P where it is relatively difficult for the peeling to take place as described above, the occurrence of jamming can be suppressed.

In this embodiment, four separation mechanisms 50 are disposed in such a manner that both the intervals d1 from the tip end claw portions 62*b* of the separation mechanisms 50 at positions in close proximity to the both end portions of the sheet passing region to the nip portion N become the smallest by disposing them so that both the intervals d1 from the tip end claw portions 62*b* of the two separation mechanisms 50 at positions in close proximity to the both end portions of the sheet passing region to the nip portion N become smaller than the intervals d2 from the tip end claw portions 62*b* of the other two separation claw portions 50 at positions in close proximity to the center portion of the sheet passing region to the nip portion N. It is thus possible to first bring the tip end claw portions 62*b* of the separation mechanisms 50 at the both end portions of the sheet passing region into contact with the front edge of a recording sheet P having passed by the nip portion N.

Accordingly, because it is possible to start the peeling of a recording sheet P from the circumferential surface of the fixing roller 41 in a reliable manner by setting the start point at the both end portions in the width direction of a recording sheet P, the peeling capability for a recording sheet P of the separation mechanisms 50 closer to the center portion can be satisfactorily enhanced by the peeling at the both end portions in the width direction of a recording sheet P. It is thus possible to further enhance the peeling capability for an entire recording sheet P including the center portion side in the width direction of a recording sheet P where it is relatively difficult for the peeling to take place, which can in turn further suppress the occurrence of jamming.

In this embodiment, because it is configured to adjust the intervals d1 and d2 from the tip end claw portions 62*b* of the separation mechanisms 50 to the nip portion N by changing the positions of arrangement of the supporting point reception portions 31 in the housing 30 with respect to the nip portion N, the separation mechanisms 50 of substantially the identical shape can be used in common. The separation mechanisms 50 can be therefore replaced when the need arises, which enhances the versatility of the components.

In this embodiment, it is configured to adjust the angles of contact, θ1 and θ2, between the tip end claw portions 62*b* and the circumferential surface of the fixing roller 41 by changing the positions of arrangement of the supporting point reception portions 31 in the housing 30 with respect to the nip portion N. It is thus possible to suppress the occurrence of an event the angles of contact, θ1 and θ2, between the tip end claw portions 62*b* of the separation mechanisms 50 and the circumferential surface of the fixing roller 41 falls outside the range of angle to achieve the satisfactory peeling capability, which makes it possible to maintain a high peeling capability with ease. In addition, there is an advantage that the effects described above can be achieved readily with a relatively simple method of merely changing the formed positions of the supporting point reception portions 31 in the housing 30.

It should be appreciated that the embodiment disclosed herein is considered as illustrative and not restrictive in all respects. The scope of the invention is therefore specified not by the description of the embodiment above, but the appended claims, and definitions equivalent to the claims and changes within the scope of the invention are included in the invention.

For example, the embodiment above described a case where the invention is applied to the printer 1 equipped with the fixing device 20. The invention, however, is not limited to this case, and it is also applicable to an image forming apparatus, such as a copying machine and a facsimile machine equipped with the fixing device, and a complex machine thereof.

Also, the embodiment above described a case where four separation mechanisms 50 are disposed side by side along the shaft center of the fixing roller 41. The invention, however, is not limited to this case, and three or five or more separation mechanisms 50 may be disposed along the shaft center of the fixing roller 41.

Figure 11:
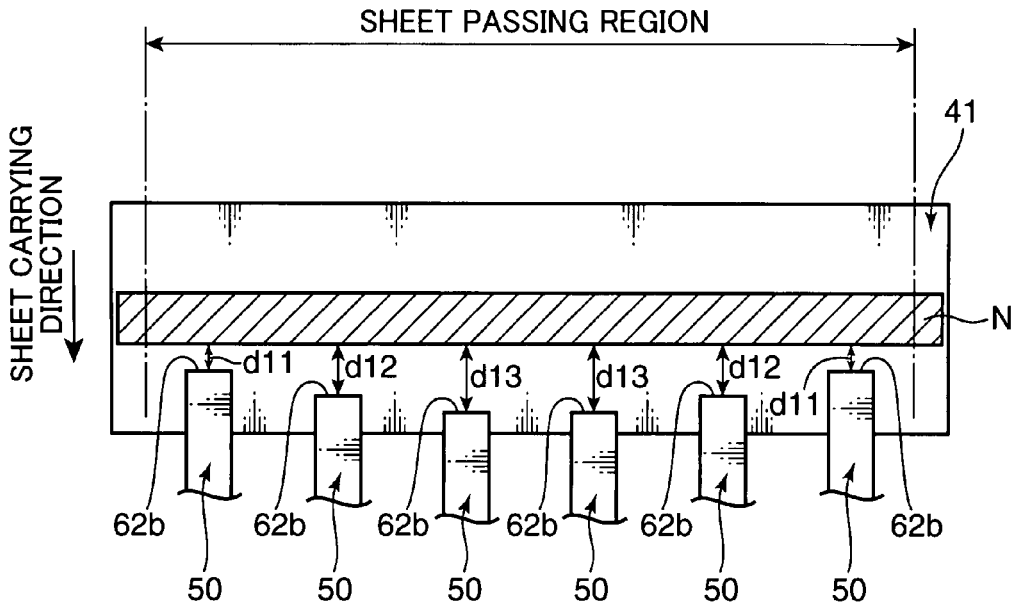
FIG. 11 is a bottom view schematically showing the positional relation of the separation mechanisms and the fixing roller in the fixing device according to a first modification of the invention.

For example, as is shown in a first modification in FIG. 11, six separation mechanisms 50 may be disposed side by side along the shaft center of the fixing roller 41. In this case, six separation mechanisms 50 are disposed in such a manner that intervals d11 from the tip end claw portions 62*b* of two separation mechanisms 50 at positions in close proximity to the both end portions of the sheet passing region of the fixing roller 41 to the nip portion N become smaller than intervals d12 and d13 from the tip end claw portions 62*b* of the other four separation mechanisms 50 at positions other than the positions in close proximity to the both end portions of the sheet passing region to the nip portion N. Further, the six separation mechanisms 50 are disposed in such a manner that the intervals d11, d12, and d13 from the tip end claw portions 62*b* to the nip portion N become gradually larger from two separation mechanisms 50 in close proximity to the both end portions of the sheet passing region toward two separation mechanisms 50 at positions in close proximity to the center portion of the sheet passing region, in short, to establish the relation, d11<d12<d13.

In the first modification, the six separation mechanisms 50 are disposed in such a manner that intervals d11 through d13 from the tip end claw portions 62*b* of the separation mechanism 50 to the nip portion N become gradually larger from two separation mechanism 50 in close proximity to the both ends portions of the sheet passing region to two separation mechanisms 50 in close proximity to the center portion of the sheet passing region. It is thus possible to bring the separation mechanisms 50 into contact with the front edge of a recording sheet P having passed by the nip portion N sequentially from the two separation mechanism 50 at the both end portions of the sheet passing region to the two separation mechanisms 50 at the center portion of the sheet passing region. Accordingly, because the peeling at the end portions in the width direction of a recording sheet P enhances the peeling capability of the separation mechanisms 50 disposed on the center portion side in the width direction sequentially from the end portion side in the width direction, it is possible to sufficiently enhance the peeling capability at the center portion in the width direction of a recording sheet P where it is most difficult for the peeling to take place.

As is shown in FIG. 9, the embodiment above described a case where four separation mechanisms 50 are disposed in such a manner that the intervals d1 from the tip end claw portions 62*b* of two separation mechanisms 50 at positions in close proximity to the both end portions of the sheet passing region of the fixing roller 41 to the nip portion N become smaller than the intervals d2 from the tip end claw portions 62*b* of the other two separation mechanisms 50 at positions in close proximity to the center portion of the sheet passing region to the nip portion N.

Figure 12:
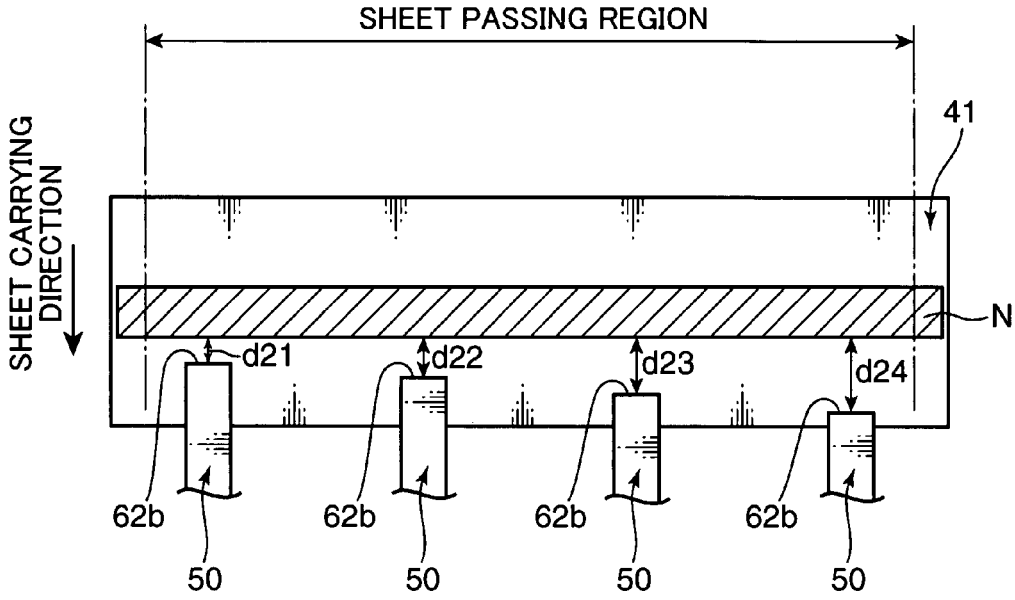
FIG. 12 is a bottom view schematically showing the positional relation of the separation mechanisms and the fixing roller in the fixing device according to a second modification of the invention.

The invention, however, is not limited to this case, and for example, as is shown in a second modification shown in FIG. 12, four separation mechanisms 50 may be disposed in such a manner that an interval d21 from the tip end claw portion 62*b* of the separation mechanism 50 at a position in close proximity to one end portion of the sheet passing region of the fixing roller 41 becomes smaller than intervals d22 through d24 from the tip end claw portions 62*b* of the other three separation mechanisms 50 at the positions other than the position in close proximity to the one end portion of the sheet passing region to the nip portion N, while the intervals d21 through d24 from the tip end claw portions 62*b* to the nip portion N become gradually larger from the separation mechanism 50 in close proximity to the one end portion of the sheet passing region to the separation mechanism 50 at a position in close proximity to the other end portion of the sheet passing region, in short, to establish the relation, d21<d22<d23<d24.

Also, the embodiment above described a case where the intervals d1 and d2 from the tip end claw portions 62*b* to the nip portion N and the angles of contact, θ1 and θ2, between the tip end claw portions 62*b* and the circumferential surface of the fixing roller 41 are adjusted by changing the positions of arrangement of the supporting point reception portions 31 in the housing 30 with respect to the nip portion N. The invention, however, is not limited to this case, and the intervals d1 and d2 from the tip end claw portions 62*b* to the nip portion N and the angles of contact, θ1 and θ2, between the tip end claw portions 62*b* and the circumferential surface of the fixing roller 41 may be adjusted by changing the forming positions of the hook engagement holes 32 and the positioning concave portions 33 made in the housing 30.

Alternatively, the intervals d1 and d2 from the tip end claw portions 62*b* to the nip portion N and the angles of contact, θ1 and θ2, between the tip end claw portions 62*b* and the circumferential surface of the fixing roller 41 may be adjusted by changing the shapes of the claw member 62 of the separation mechanism 50 in various manners. Moreover, in a case where the intervals d1 and d2 or the angles of contact, θ1 and θ2, or the both need only a slight adjustment, an adjustment may be made by changing the concave shape of the supporting point reception portions 31 instead of changing the positions of arrangement of the supporting point reception portions 31.

The specific embodiment described above includes inventions including the following configurations.

A fixing device according one aspect of the invention includes: a fixing roller that heats a toner image; a pressure roller that forms a nip portion together with the fixing roller by coming into contact with the fixing roller with pressing and fixes the toner image on a recording sheet in the nip portion; and plural separation claws that are disposed side by side along a shaft center of the fixing roller within a sheet passing region of the fixing roller on a downstream side from the nip portion in a carrying direction of the recording sheet and separate the recording sheet from the fixing roller, wherein each of the plural separation claws includes a tip end claw portion that comes into contact with a circumferential surface of the fixing roller, and the plural separation claws are disposed in such a manner that an interval from the tip end claw portion of a separation claw at a position in close proximity to at least one end portion of the sheet passing region to the nip portion becomes smaller than an interval from the tip end claw portion of a separation claw at a position other than the position in close proximity to the end portion to the nip portion.

In addition, an image forming apparatus according to another aspect of the invention includes an image forming portion that transfers a toner image on a recording sheet, and a fixing device that fixes the toner image transferred in the image forming portion on the recording sheet by heating, and the fixing device has the configuration described above.

According to these configurations, because plural separation claws are disposed in such a manner that the interval from the tip end claw portion of the separation claw at the position in close proximity to the end portion of the paper passing region to the nip portion becomes the smallest, it is possible to first bring the tip end claw portion of the separation claw at the end portion in the paper passing region into contact with the front edge of a recording sheet having passed by the nip portion. The peeling load of the separation claws is larger in the center portion than in the end portion in the width direction of a recording sheet. According to the configuration described above, it is possible to start the peeling of a recording sheet from the circumferential surface of the fixing roller in a reliable manner by setting the start point at the end portion in the width direction of a recording sheet. The peeling at the end portion in the width direction of a recording sheet can reduce the closely contacting area of a recording sheet and the fixing roller having the center at the peeling start point by the separation claw disposed at a position closer to the center portion in the width direction. It is thus possible to enhance the peeling capability for a recording sheet of the separation claw closer to the center portion. Because it is possible to enhance the peeling capability for an entire recording sheet including the center portion side in the width direction of a recording sheet where it is relatively difficult for the peeling to take place as described above, the occurrence of jamming can be suppressed.

In the configurations described above, it is preferable that the plural separation claws are disposed in such a manner that intervals from the tip end portions to the nip portion become gradually larger from the separation claw in close proximity to the end portion of the sheet passing region to a separation claw at a position in close proximity to a center portion of the sheet passing region.

According to this configuration, it is possible to bring the separation claws into contact with the front edge of a recording sheet having passed by the nip portion successively from the separation claw at the end portion of the paper passing region to the separation claw at the center portion of the paper passing region. Accordingly, because the peeling at the end portion in the width direction of a recording sheet enhances the peeling capability of the separation claw disposed on the center portion side in the width direction sequentially from the end portion side in the width direction, it is possible to enhance the peeling capability in a satisfactory manner at the center portion in the width direction of a recording sheet where it is most difficult for the peeling to take place.

In the configurations described above, it is preferable that the plural separation claws are disposed in such a manner that intervals from the tip end claw portions of separation claws at positions in close proximity to both end portions of the sheet passing region to the nip portion become smaller than intervals from the tip end claw portions of separation claws at positions other than the positions in close proximity to the both end portions to the nip portion.

According to this configuration, it is possible to first bring the tip end claw portions of the separation claws at the both end portions in the sheet passing region into contact with the front edge of a recording sheet having passed by the nip portion. Accordingly, because it is possible to start the peeling of a recording sheet from the circumferential surface of the fixing roller in a reliable manner by setting the start point at the both end portions in the width direction of a recording sheet, the peeling at the both end portions in the width direction of a recording sheet can enhance the peeling capability for a recording sheet of the separation claws closer to the center portion in a satisfactory manner. Hence, because it is possible to further enhance the peeling capability for an entire recording sheet including the center portion side in the width direction of a recording sheet where it is relatively difficult for the peeling to take place, the occurrence of jamming can be further suppressed.

In the configurations described above, it is preferable to further include supporting members that support the separation claws in a posture that allows the separation claws to come into contact with the fixing roller, and it is preferable that intervals from the tip end claw portions of the separation claws to the nip potion are determined by positions of arrangement of the supporting members with respect to the nip portion.

According to this configuration, because it is configured to adjust intervals from the tip end claw portions to the nip portion by changing the positions of arrangement of the supporting portions with respect to the nip portion, the separation claws of substantially the identical shape can be used in common. It is therefore possible to enhance the versatility of the components.

In this case, it is preferable that angles of contact between the tip end claw portions of the separation claws and the circumferential surface of the fixing roller are determined by positions of arrangement of the supporting members with respect to the nip portion.

For example, in a case where the separation claws are brought into contact with the fixing roller in a specific posture, the angles of contact between the tip end claw portions of the separation claws and the circumferential surface of the fixing roller vary when the contact positions to the circumferential surface of the fixing roller are different. In this case, a satisfactory peeling capability of the separation claws may not be achieved depending on the angles of contact. However, according to the configuration described above, because it is possible to suppress the occurrence of an event that the angles of contact between the tip end claw portions of the separation claws and the circumferential surface of the fixing roller falls outside the range of angle to achieve the satisfactory peeling capability, it is possible to maintain a high peeling capability with ease. In addition, the effect described above can be achieved readily by a relatively simple method of merely changing the positions of arrangement of the supporting members with respect to the nip portion.

In the configurations described above, it is preferable to further include holding portions that hold the separation claws so as to be able to oscillate, and pushing members that push the separation claws toward the circumferential surface of the fixing roller so that the tip end claw portions of the separation claws press the fixing roller.

In this case, it is preferable that the separation claws have oscillation supporting point portions of an almost spherical shape, and that the holding portions are cone-shaped supporting point reception portions that receive the oscillation supporting point portions and the separation claws are held by the holding portions to be able to oscillate in multiple axial directions.

Also, in the configurations described above, it is preferable that the fixing roller includes a cylindrical body made of metal, and that the tip end claw portions of the separation claws are formed in a shape of a flat plate.

According to the fixing device and the image forming apparatus of the invention described above, because it is possible to first bring the tip end claw portions of the separation claws at the end portions of the sheet passing region into contact with the front edge of a recording sheet having passed by the nip portion, the peeling of a recording sheet from the circumferential surface of the fixing roller can be started in a reliable manner by setting the start point at the end potions in the width direction of a recording sheet. Hence, because it is possible to reduce the closely contacting area of a recording sheet and the fixing roller having the center at the peeling start point by the separation claw disposed at positions closer to the center portion in the width direction, the peeling capability for a recording sheet of the separation claws closer to the center portion can be enhanced. Because this configuration makes it possible to enhance the peeling capability for an entire recording sheet including the center portion side in the width direction of a recording sheet where it is relatively difficult for the peeling to take place, the occurrence of jamming can be suppressed.

This application is based on patent application No. 2006-151058 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A fixing device that fixes a toner image transferred onto a recording sheet on the recording sheet by heating, comprising:

a fixing roller that heats the toner image;

a pressure roller that forms a nip portion together with the fixing roller by coming into contact with the fixing roller with pressing and fixes the toner image on the recording sheet in the nip portion;

plural separation claws that are disposed side by side along a shaft center of the fixing roller within a sheet passing region of the fixing roller on a downstream side from the nip portion in a carrying direction of the recording sheet and separate the recording sheet from the fixing roller, and supporting members that support the separation claws in a posture that allows the separation claws to come into contact with the fixing roller, wherein:

each of the plural separation claws includes a tip end claw portion that comes into contact with a circumferential surface of the fixing roller;

the plural separation claws are disposed in such a manner that an interval from the tip end claw portion of a separation claw at a position in close proximity to at least one end portion of the sheet passing region to the nip portion becomes smaller than an interval from the tip end claw portion of a separation claw at a position other than the position in close proximity to the end portion to the nip portion, and intervals from the tip end claw portions of the separation claws to the nip portion and angles of contact between the tip end claw portions of the separation claws and the circumferential surface of the fixing roller are determined by positions of arrangement of the supporting members with respect to the nip portion.

2. The fixing device according to claim 1, wherein:

the plural separation claws are disposed in such a manner that intervals from the tip end portions to the nip portion become gradually larger from the separation claw in close proximity to the end portion of the sheet passing region to a separation claw at a position in close proximity to a center portion of the sheet passing region.

3. The fixing device according to claim 1 wherein:

the plural separation claws are disposed in such a manner that intervals from the tip end claw portions of separation claws at positions in close proximity to both end portions of the sheet passing region to the nip portion become smaller than intervals from the tip end claw portions of separation claws at positions other than the positions in close proximity to the both end portions to the nip portion.

4. The fixing device according to claim 1, further comprising:

holding portions that hold the separation claws so as to be able to oscillate; and pushing members that push the separation claws toward the circumferential surface of the fixing roller so that the tip end claw portions of the separation claws press the fixing roller.

5. The fixing device according to claim 4, wherein:

the separation claws have oscillation supporting point portions of an almost spherical shape; and the holding portions are cone-shaped supporting point reception portions that receive the oscillation supporting point portions and the separation claws are held by the holding portions to be able to oscillate in multiple axial directions.

6. The fixing device according to claim 1, wherein:

the fixing roller includes a cylindrical body made of metal; and the tip end claw portions of the separation claws are formed in a shape of a flat plate.

7. An image forming apparatus, comprising:

an image forming portion that transfers a toner image on a recording sheet; and a fixing device that fixes the toner image transferred in the image forming portion on the recording sheet by heating, wherein the fixing device includes:

a fixing roller that heats the toner image;

a pressure roller that forms a nip portion together with the fixing roller by coming into contact with the fixing roller with pressing and fixes the toner image on the recording sheet in the nip portion;

plural separation claws that are disposed side by side along a shaft center of the fixing roller within a sheet passing region of the fixing roller on a downstream side from the nip portion in a carrying direction of the recording sheet and separate the recording sheet from the fixing roller, and supporting members that support the separation claws in a posture that allows the separation claws to come into contact with the fixing roller, wherein:

each of the plural separation claws includes a tip end claw portion that comes into contact with a circumferential surface of the fixing roller; and the plural separation claws are disposed in such a manner that an interval from the tip end claw portion of a separation claw at a position in close proximity to at least one end portion of the sheet passing region to the nip portion becomes smaller than an interval from the tip end claw portion of a separation claw at a position other than the position in close proximity to the end portion to the nip portion, and intervals from the tip end claw portions of the separation claws to the nip portion and angles of contact between the tip end claw portions of the separation claws and the circumferential surface of the fixing roller are determined by positions of arrangement of the supporting members with respect to the nip portion.

8. The image forming apparatus according to claim 7, wherein:

the plural separation claws are disposed in such a manner that intervals from the tip end portions to the nip portion become gradually larger from the separation claw in close proximity to the end portion of the sheet passing region to a separation claw at a position in close proximity to a center portion of the sheet passing region.

9. The image forming apparatus according to claim 7, wherein:

the plural separation claws are disposed in such a manner that intervals from the tip end claw portions of separation claws at positions in close proximity to both end portions of the sheet passing region to the nip portion become smaller than intervals from the tip end claw portions of separation claws at positions other than the positions in close proximity to the both end portions to the nip portion.

10. The image forming apparatus according to claim 7, further comprising:

holding portions that hold the separation claws so as to be able to oscillate; and pushing members that push the separation claws toward the circumferential surface of the fixing roller so that the tip end claw portions of the separation claws press the fixing roller.

11. The image forming apparatus according to claim 10, wherein:

the separation claws have oscillation supporting point portions of an almost spherical shape; and the holding portions are cone-shaped supporting point reception portions that receive the oscillation supporting point portions and the separation claws are held by the holding portions to be able to oscillate in multiple axial directions.

12. The image forming apparatus according to claim 7, wherein:

the fixing roller includes a cylindrical body made of metal; and the tip end claw portions of the separation claws are formed in a shape of a flat plate.

* * * * *